US006170095B1

(12) United States Patent
Zars

(10) Patent No.: US 6,170,095 B1
(45) Date of Patent: Jan. 9, 2001

(54) MAIN DRAIN SAFETY GRATE APPARATUS

(76) Inventor: Leif Alexander Zars, 11815 Coker Loop West, San Antonio, TX (US) 78216

( * ) Notice: Under 35 U.S.C. 154(b), the term of this patent shall be extended for 0 days.

(21) Appl. No.: 09/098,119

(22) Filed: Jun. 16, 1998

Related U.S. Application Data

(60) Provisional application No. 60/049,772, filed on Jun. 16, 1997.

(51) Int. Cl.[7] ..... E04H 4/00

(52) U.S. Cl. ..... 4/507; 4/504

(58) Field of Search ..... 4/507, 508, 510, 4/504, 496; 210/163, 164

(56) References Cited

U.S. PATENT DOCUMENTS

| | | | | |
|---|---|---|---|---|
| 3,940,807 | | 3/1976 | Baker et al. . | |
| 4,121,307 | | 10/1978 | Patterson . | |
| 4,658,449 | | 4/1987 | Martin . | |
| 4,815,888 | * | 3/1989 | Stegmeier | 4/506 |
| 5,408,706 | * | 4/1995 | Barnes | 4/507 |

FOREIGN PATENT DOCUMENTS

| | | | | |
|---|---|---|---|---|
| 4010862 | * | 4/1991 | (DE) | 4/504 |

* cited by examiner

*Primary Examiner*—David J. Walczak
(74) *Attorney, Agent, or Firm*—Akin, Gump, Strauss, Hauer & Feld, LLP

(57) ABSTRACT

A main drain safety grate apparatus utilizes an elongate drain, frame and grate that distribute the suction flow of water over a large surface to avoid full blockage of the grate, and also utilizes a bendable or deformable, upwardly releasable grate that has a section slotted to permit water to drain therethrough. The grate is ordinarily restrained from upward movement by a slot in each end of the frame into which the ends of the grate fit, and from downward movement by two shelves on which the grate may be supported. The grate may be released from the frame by an upward force applied at the section provided for drainage, which bends, or bows, the grate in an arcuate shape, and acts to shorten the length of the grate relative to the slots into which it is fitted. The bowing effect also serves to rotate a rounded surface and a corner of the end of the grate so as to reduce the effective length by rotating the corner away from the point of contact of the slot and the grate, and permitting that contact point to move over the rounded surface.

42 Claims, 8 Drawing Sheets

FIG. 3A
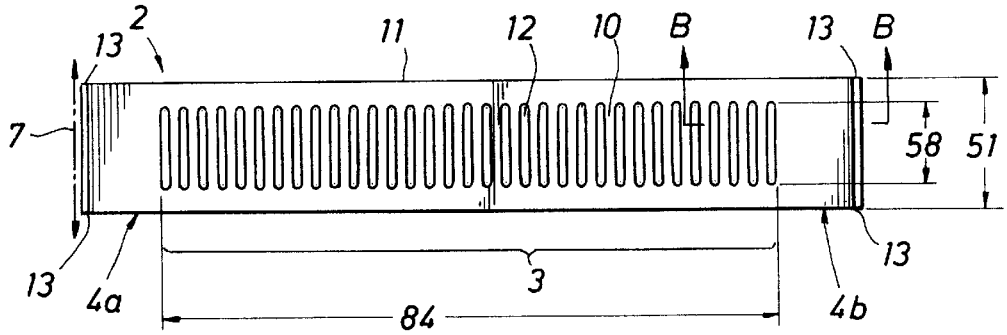
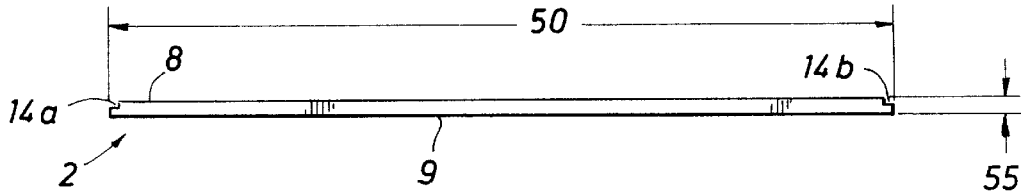
FIG. 3B
FIG. 3C
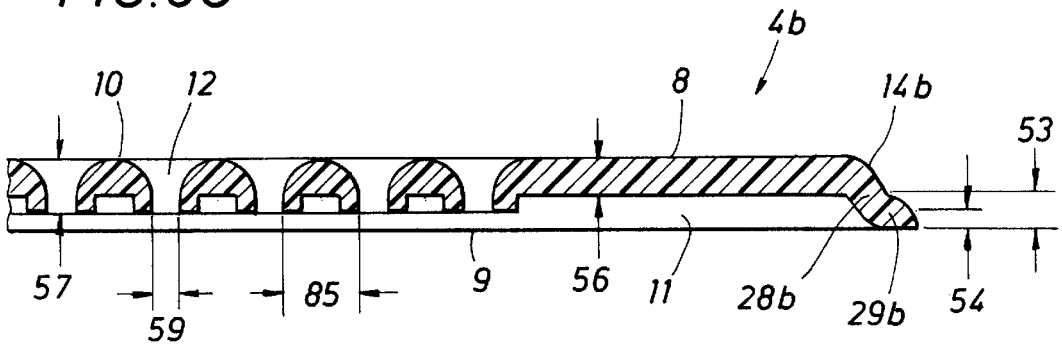
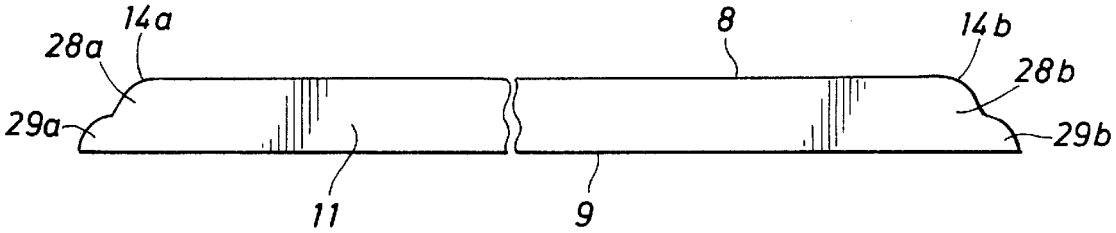
FIG. 3D

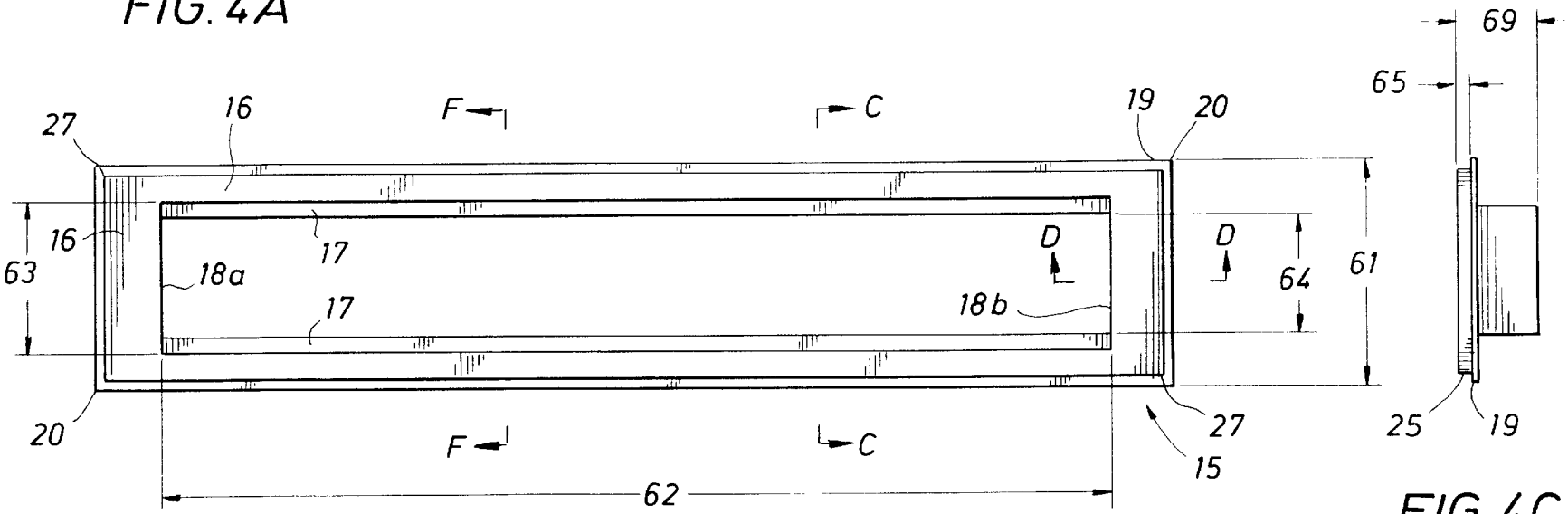
FIG. 4C
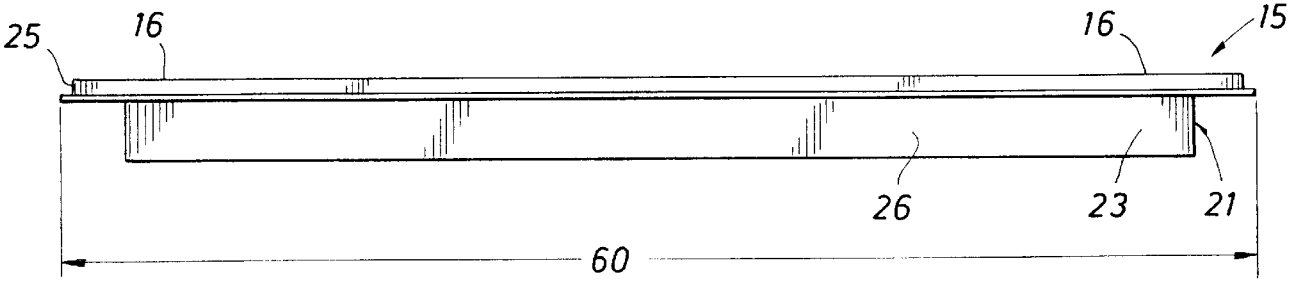
FIG. 4B
FIG. 4A

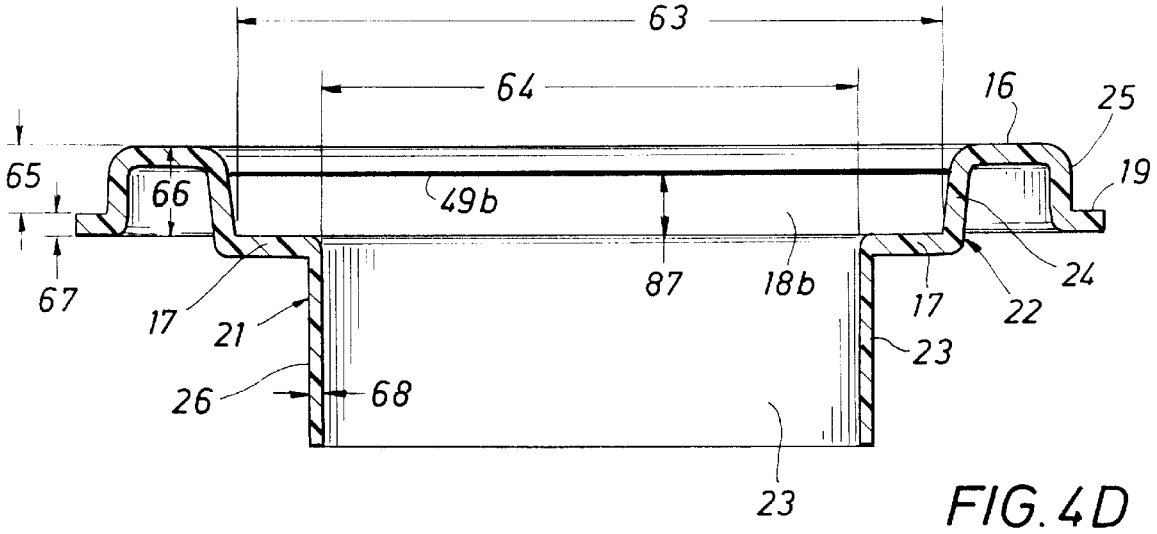
FIG. 4D
FIG. 4E
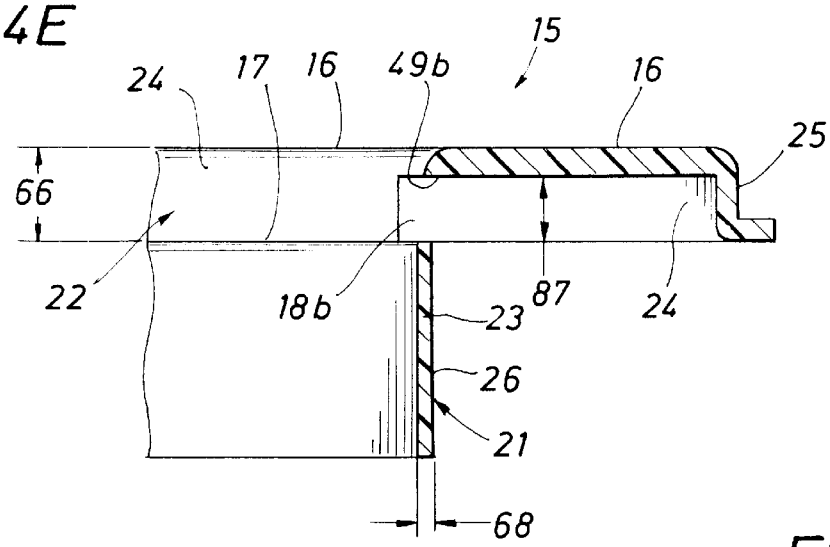
FIG. 4F
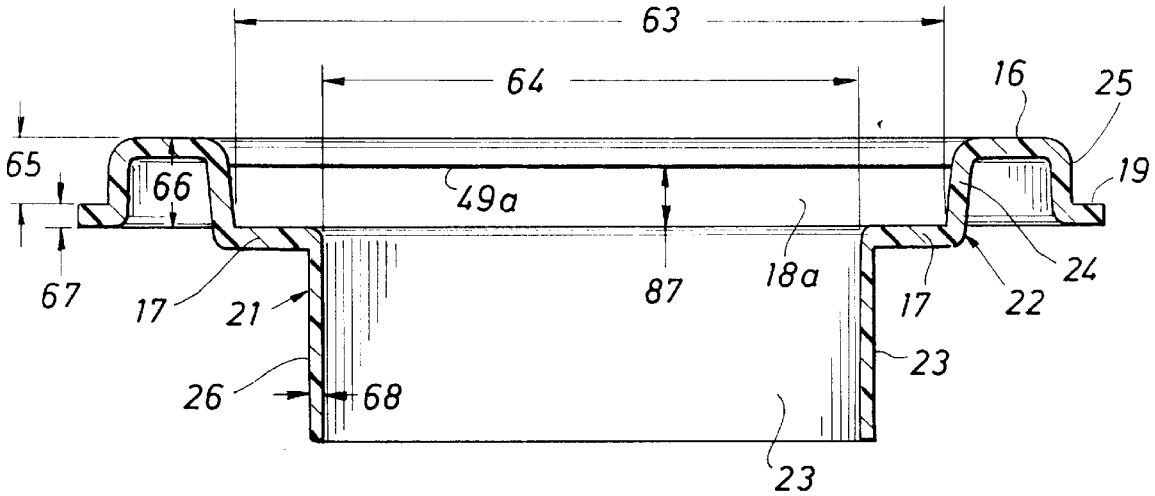

MAIN DRAIN SAFETY GRATE APPARATUS

This application is a continuation-in-part of the present applicant's co-pending provisional application Serial No. 60/049,772, filed Jun. 16, 1997, and claims priority therefrom.

BACKGROUND OF THE INVENTION

The present invention relates to a device to prevent injuries and deaths associated with the main drain of a swimming pool or spa. Pools and spas use a pump to permit the water to circulate both within the spa or pool, through conditioning or heating apparatus and the like, and back to the spa or pool. The point or points from which the pump draws water from the structure, often known as the main drain, can be very dangerous to persons within the structure because of the risks associated with the possibility that a person, or a part of their body might cover, or blind off, that main drain. By covering all or part of that drain, greatly increased suction may result at that point, acting to trap the person. If the person's face is below water at that time, they may drown. Another risk is that of a person (often a child) placing their buttocks over, and covering, the drain. This occurs most frequently on drains where the grate is missing, but may also occur on flat drain covers that can be so covered and collapse with the increased suction. In this case, the greatly increased suction can act to eviscerate the person through their anus, permanently injuring them. Another risk is of a person's hair becoming entangled in a grate, trapping the person next to the drain, resulting in drowning.

Conventional drain systems have used "anti-vortex" covers, which lack holes at the top, preventing or discouraging a person from covering that hole, and which reduce flow rates (to perhaps less than 6 ft./sec.) to reduce turbulence. Covering the drain with a grate, often having ½ inch openings, have also been used.

Other conventional drain systems have used dual or multiple main drains, separated by sufficient distance to prevent both from being covered, ideally reducing the pressure should one become covered, or a plumbing design that prevents any single drain becoming connected exclusively to a suction pump. Further ways include gravity-fed collector sumps, and vent stacks, which attempt to limit total suction to about 8 ft.-$H_2O$.

One disadvantage of conventional systems is that they often involve extra components, adding complexity and cost to the system. Another disadvantage is that the grates or other covers may fail, permitting a person to cover that drain, and become entrapped, or disemboweled. Another is that even grates designed to be anti-vortex may still permit hair entanglement in the drain cover support attachment points or in the cover openings themselves. Further, it is not clear that multiple drains per pump provide sufficient protection because of the potential for dynamic hydraulic imbalance, which may still permit a large increase in suction at the drain.

Previous drains and suction entrapment devices for pools or spas disclosed in patents include the following:

U.S. Pat. No. 5,734,999 discloses a floor drain grate that including two or three separate regions through which water can flow into the drain. The regions are spaced-apart, preferably one to two feet, to effectively prevent a swimmer from covering all openings simultaneously, preventing suction entrapment. One or more elongate channel portions are used to create a flow passage structure to space apart the inflow regions, and a central portion overlies the drain, and provides a further inflow region. The floor drain grate, including the channel portions, is disclosed as overlying the pool floor. The central portion is disclosed as being securely attached to the drain, using screws, and the channel portions are disclosed as being integrally formed with the central portion, or as being attached thereto using screws or adhesives.

U.S. Pat. No. 3,940,807 discloses an outlet drain for a spa including channels extending radially substantially in all directions from the central drain aperture through which water can enter the drain. The channels extend approximately two feet, from the ends of opposing channels, to effectively prevent a swimmer from covering all of the channels simultaneously, preventing suction entrapment. It also discloses an anti-vortex plate covering the drain sump. The drain is disclosed as being able to be integrally molded with or bonded to the bottom of the pool, or to replace the existing drain in a pool or spa. The vortex plate is disclosed as being held in position by screws, and the retrofittable drain is held in place by spring clips that apply a downward force to provide a secure fit and to prevent unintended removal.

U.S. Pat. No. 4,658,449 discloses an adapter for pool drains that uses an upper ring raised from the surface of the pool floor, and arms radiating downward therefrom to a lower ring, or perimeter frame, that rests on the floor of the pool, to define a raised screening surface above the pool drain. The larger surface area provides a greater area for suction to reduce the suction at any given point. The adapter is also disclosed to use either a heavy metallic mesh or plurality of metallic arms among the radiating arms and the top of the upper ring to reduce the whirlpool effect. The perimeter frame is disclosed as having mounting arms that run across it, intersecting the pool drain, to permit the adapter to be bolted or screwed to the drain.

U.S. Pat. No. 4,121,307 discloses a pool having an open gutter around its perimeter, including therein a suction pipe providing positive withdrawal of water in the gutter. The bottom of the pool is shown to have a main drain utilizing an elongated grate. The grate is not described as being removable.

SUMMARY OF THE PRESENT INVENTION

The present invention provides a single device that eliminates the three basic hazards associated with swimming pool main drains: suction entrapment, disembowelment and hair entrapment. It does so by preventing the great increases in pressure associated with a suction inlet being covered by a person's body, thus preventing a person's limb or body from being entrapped, or the person from being disemboweled. It also provides a "breakaway" grate that allows a person whose hair is entrapped to rise to the surface safely, but does not ordinarily permit the removal of the protective grate without tools.

To accomplish the first object, the entire main drain system is configured into a long narrow device which, by its shape, precludes it from being covered by a swimmer's body, because a person's body simply can not conform to blind off this grate. By using this long, or elongate, shape, even should a person press up against the drain, some part of the grate will be left uncovered, permitting the water to continue to enter the drain and preventing the sharp pressure increase associated with the stopping of water flow. It also avoids concern regarding potential suction increases resulting from hydraulic imbalance because water flow continues at that drain and need not shift elsewhere. Thus by being unable to be closed off by a body, the mere design thereby precludes the suction entrapment of a bather due to increased pump suction.

The second object is met by using a "breakaway", deformably releasable, grate. This grate serves as an effective means of eliminating the hazard of hair entrapment (usually young girls with long hair playing in the spa). Should hair become entrapped in the grate, an upward pull on the hair, as by a person seeking to escape, will cause the grate to bow and thus release from its slots in the frame (about a 7 pound pull at the outer ends), allowing the bather to safely return to the surface where the entanglement can easily be removed. Further, due to the length of the slotted design grate (and the increase in flow area), the water velocity through the grate is significantly reduced so that the usual turbulence associated with hair entanglement is significantly reduced.

In a preferred embodiment, the drain comprises three parts: the sump, the frame and the grate. The sump serves as the forming shell to provide a water tight water gathering void for the water being drained from the pool at this location. It serves to hold the concrete from occupying this area when pouring or guniting a pool. In other forms of pool construction it serves to prevent either the dirt, sand, or other construction materials from occupying this area. The sump has a suction pipe connection at either end thus facilitating dual suction lines from the single unit.

The frame fits snugly into the sump around the edges and serves to provide a means of leveling the top of the drain with the finished pool floor. It will slide within the sump to provide this leveling effect. It is generally held in place by the plaster coat in concrete/gunite type pools, and can be held in place in other types of construction with either a flange attached to the liner or fiberglass for these types of construction. The frame also has a slot at either end to receive the grate.

The grate serves as a slotted cover for the sump, thus preventing entry of hands and feet, and providing a smooth surface for the floor of the pool in this area. The grate is elongate, being approximately six times as long as it is wide, and is deformable. This elongated shape assists the grate to deform by bowing along its longitudinal axis, which it will do when sufficient force is applied in an upward direction. When deformed in this manner, the length of the grate in the plane between the two slots in the frame will decrease, and at least one end of the grate will release from the corresponding slot in the frame that retains it in position. The ends of the grate are tapered to assist in the grate's release from the frame. This grate is thus deformably releasable. The slots in the grate are of the size to preclude the ability of fingers to fit therein thus to remove the grate will require some type of "tool". They are also sized to allow the designed quantity of water flow to enter the sump.

Further advantages and applications will become apparent to those skilled in the art from the following detailed description of the preferred embodiment and the drawings referenced therein, the invention not being limited to any particular embodiment.

BRIEF DESCRIPTION OF THE DRAWINGS

FIGS. 3A–B depict an exemplary grate of the present invention in plan and elevation views.

FIGS. 3C and 3D is a detailed view of section B—B of FIG. 3A.

FIG. 3D is a partial, detailed, plan view of the present invention.

FIGS. 4A–C depict an exemplary frame of the present invention in plan, elevation and side views.

FIG. 4D depicts section C—C of FIG. 4A.

FIG. 4E depicts section D—D of FIG. 4A.

FIG. 4F depicts section F—F of FIG. 4A.

DETAILED DESCRIPTION OF THE PREFERRED EMBODIMENT

Figure 1:
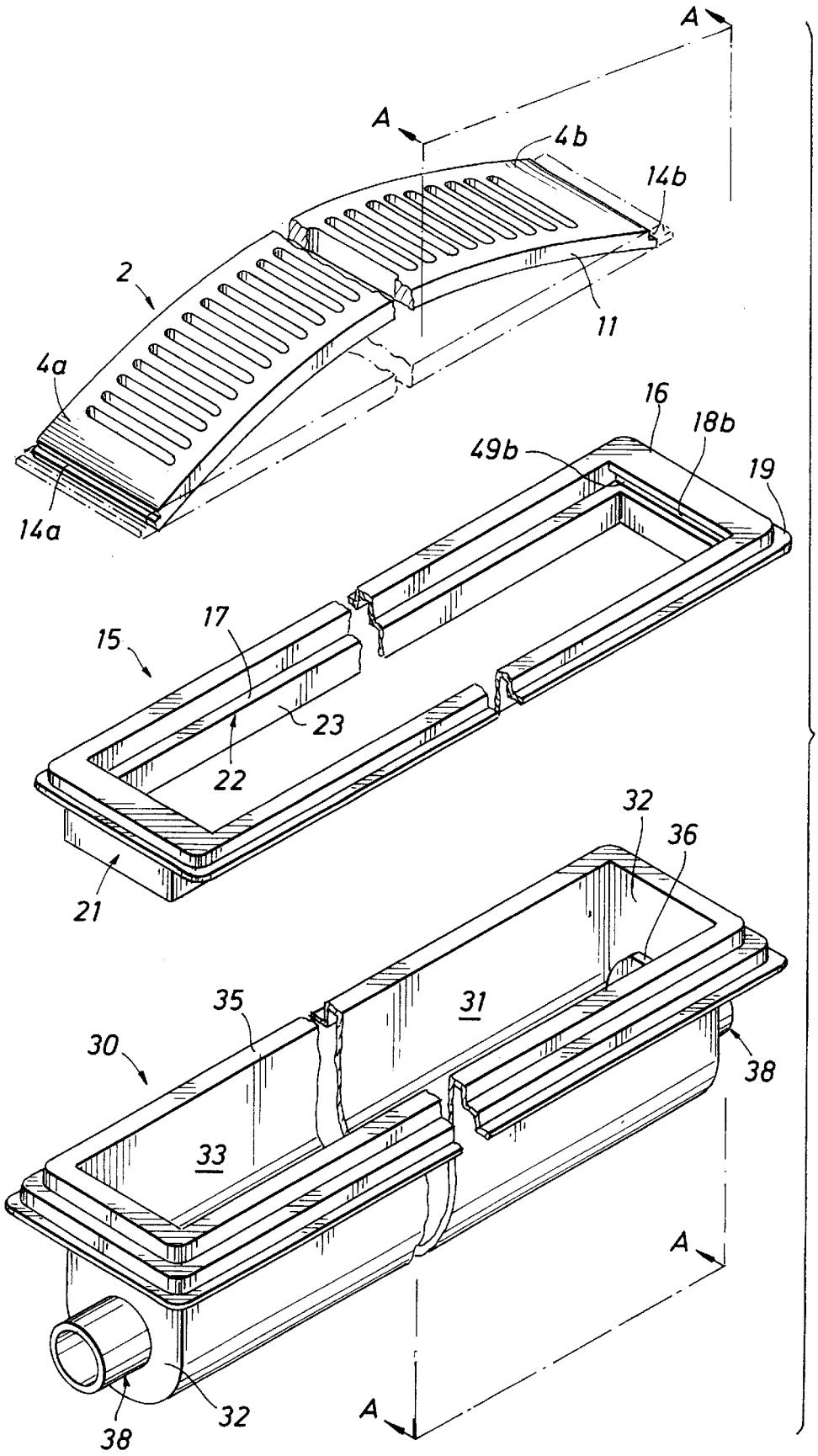
FIG. 1 shows an exploded view of an exemplary safety grate apparatus constructed in accordance with the present invention.

Referring now to the figures for a more detailed description, FIG. 1 shows an exploded view of safety grate apparatus 1. Grate 2 is shown in a bowed state as it would be when releasing from frame 15. In the embodiment in FIGS. 1 and 2, safety grate apparatus 1, including grate 2, is constructed of molded ABS, but may be made of any similar material with which the person of ordinary skill is familiar. Grate 2, in particular, is flexible. The bowing effect on grate 2 results from upward force applied to grate 2 between left and right grate-ends 4*a*, 4*b*, and downward forces resisting movement at grate-ends 4*a*, 4*b*, because grate 2 is engaged with frame 15 by grate-ends 4*a*, 4*b*. Turning to FIGS. 4D and 4E, frame 15 (shown generally in FIG. 4A) engages grate-ends 4*a*, 4*b* of grate 2 of FIG. 3B in left and right slots 18*a*, 18*b* visible in FIGS. 4D and 4F and acts to oppose the downward motion at left and right slot tops 49*a*, 49*b* visible in FIGS. 4D and 4F. Turning to FIGS. 3C and 3D the downward force acts on left and right tapers 14*a*, 14*b* and specifically on one or both of left angle section 28*a* or left convex tab 29*a*, and on right angle section 28*b* or right convex tab 29*b*. As grate 2 bows, convex tabs 29*a*, 29*b* rotate downward about transverse axis 7 (seen in FIG. 3A) moving the flat side of convex tabs 29*a*, 29*b* that are part of lower surface 9 away from left and right slots 18*a*, 18*b* reducing the length of grate 2 and assisting in its release from frame 15 (all shown in FIG. 4A).

Returning to FIG. 1, Edges 11 of grate 2 (detail shown in FIG. 3C) rest upon shelves 17 (detail shown in FIG. 4D) when not bowing upwardly. Liquid channel 21 (detail shown in FIG. 4B) fits snugly within cavity 31 of sump 30. Details of the fitting surfaces, end surfaces 32, and side surfaces 33 of cavity 31, are shown in FIGS. 5A and 5D. Ledge 36 is cut from outlet assembly 38 to permit insertion of frame 15 of FIG. 4C into sump 30 up to its maximum proper depth.

Figure 2:
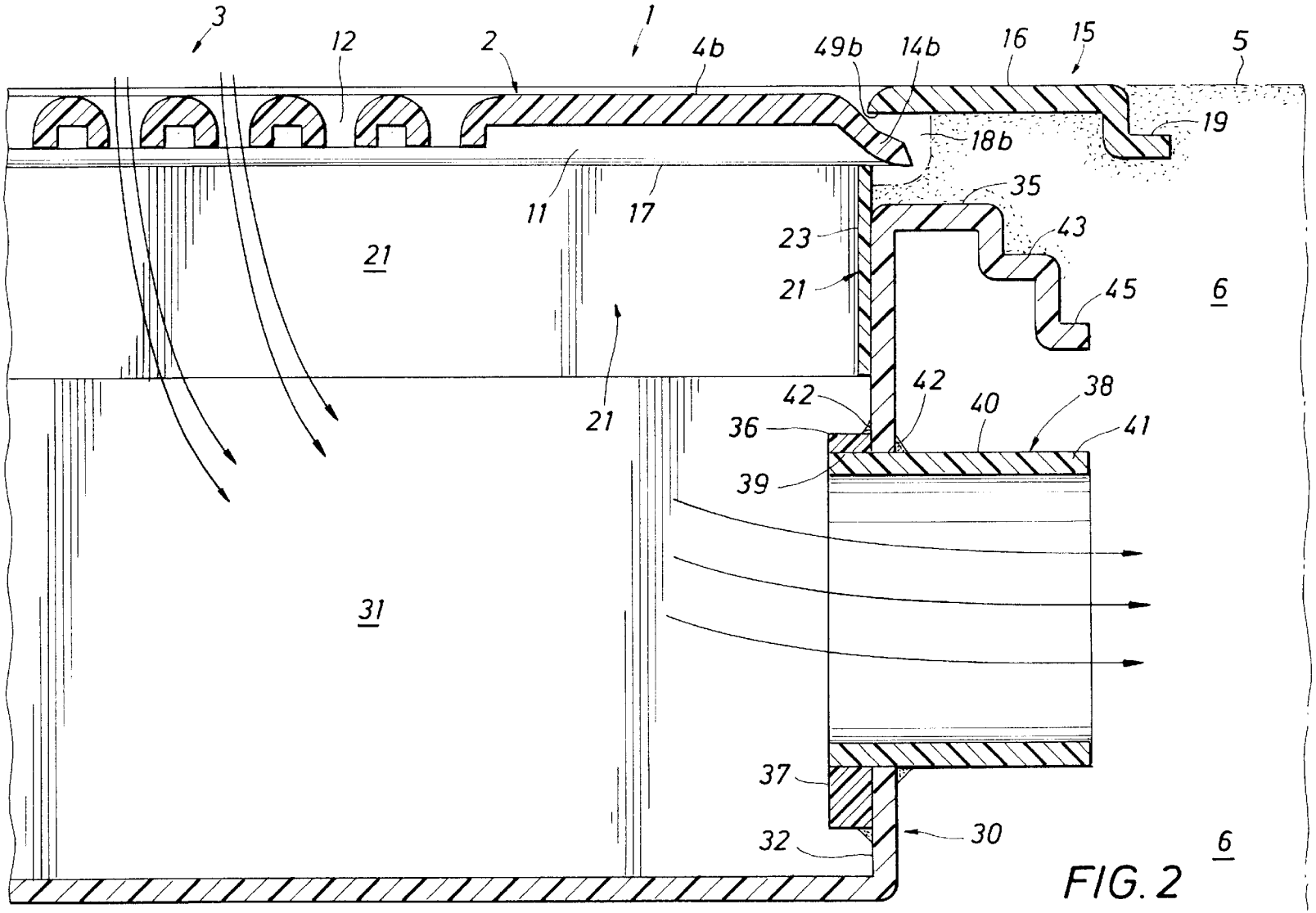
FIG. 2 depicts section A—A of FIG. 1, as the assembled device would be installed in the floor of a pool or spa.

Referring now to FIG. 2, it shows safety grate apparatus 1 as installed in pool floor 5. Sump 30 and frame 15 are embedded within pool structure 6. Grate 2, is in the present invention, removable as shown above in FIG. 1, but here is shown in place. Sump 30 is emplaced at a level below pool floor 5, with step 43, flange 45, and suction pipe connections 41 retaining it in position. Outlet assemblies 38 serve to connect sump 30 to piping system (not shown) to remove water from safety grate apparatus 1. Lower section 23 of liquid channel 21 of frame 15 is inserted within cavity 31 of sump 30. Because lower section 23 may translate vertically within cavity 31 of sump 30 prior to completion of pool structure 6, frame face 16 may be adjusted during construction to be level with pool floor 5. Once frame 15 and sump 30 are in place and pool floor 5 has been finished, grate 2 may be inserted by bowing it slightly (shown in FIG. 1) so that taper 14*b* of right grate-end 4*b* may be inserted into right slot 18*b*,and similarly for the left end. For insertion, right taper 14*b* may be inserted into corresponding slot, 18*b*, while grate 2 is at a slight angle to frame 15. A relatively small force is applied to the other grate end, 4*a*, and at that same location, a torque applied tending to bend draining section 3 upward. Grate 2 will bow enough so that taper 14*a* opposite taper 14*b* injected into slot 18*b* will be able to snap into its corresponding slot, 18*a*. This process may be reversed to insert grate 2 into slot 18*a* first.

Figure 5C:
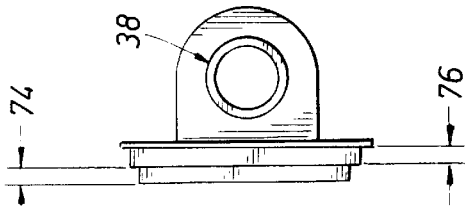
FIGS. 5A–C depict an exemplary sump of the present invention in plan, elevation and side views.
Figure 5A:
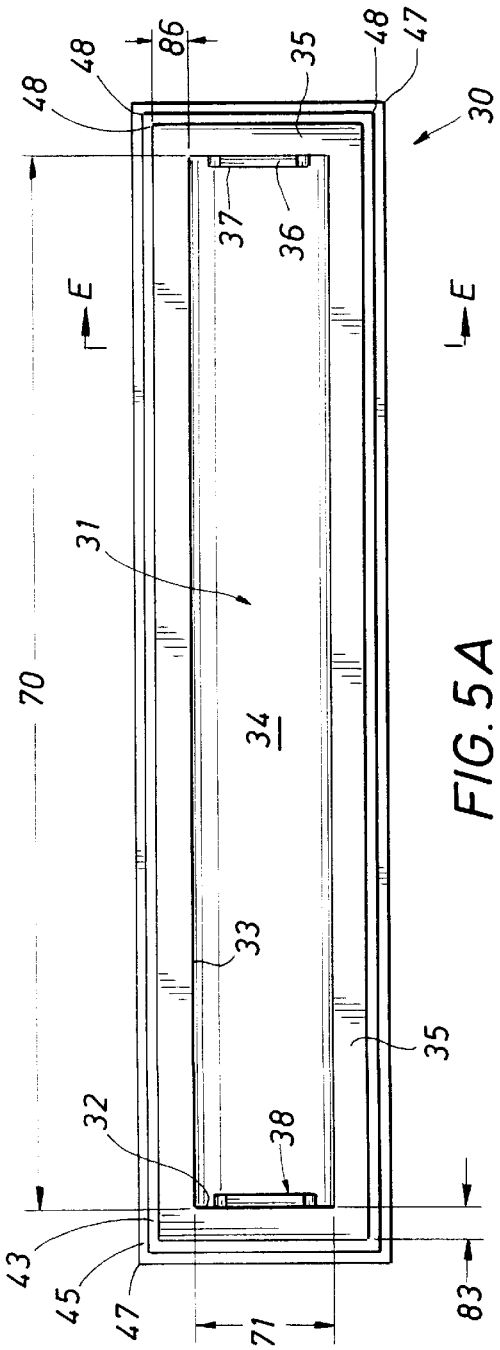
Figure 5B:
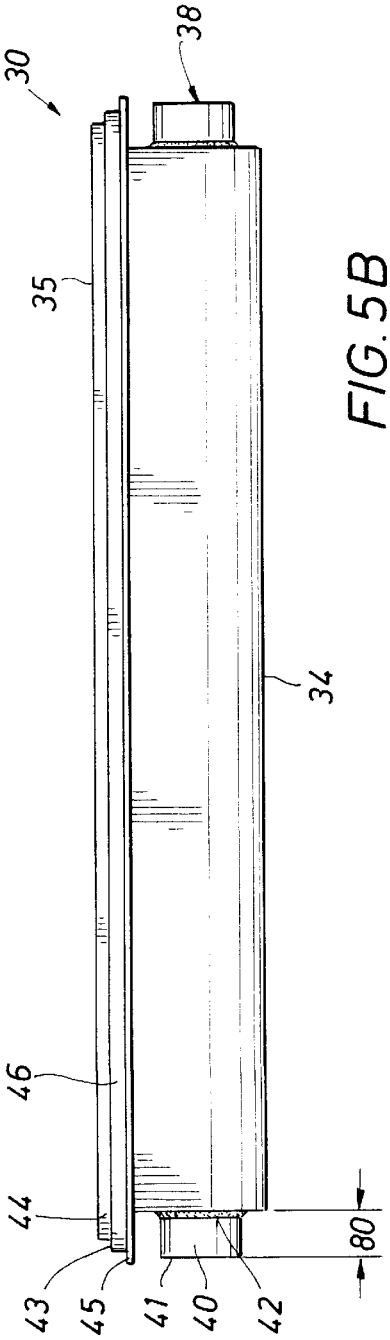

In operation, a conventional pump (not shown) applies suction through conventional pipes (not shown) connected to suction pipe connections 41 (also shown in FIG. 5B). This in turn draws water through drain slots 12 of grate 2 through liquid channel 21 of frame 15 and into cavity 31 of sump 30. From there it is drawn through outlet assemblies 38 to the conventional piping system (not shown).

Referring now to FIG. 3A, grate 2 includes draining section 3, having drain slots 12 created by the spaces between slot struts 10. Grate 2 also has left and right grate-ends 4*a*, 4*b* which have left and right tapers 14*a*, 14*b*, (shown in FIGS. 3C and 3D). Continuing in FIG. 3C, upper surface 8 of grate 2 is substantially level, with right grate-end 4*b* and right taper 14*b* being narrower. Left grate-end 4*a* is similar. Returning to FIG. 3A, transverse axis 7 runs parallel to both grate-ends 4*a*, 4*b* and tapers 14*a*, 14*b*. In FIGS. 3C and 3D edges 11 of the long sides of grate 2 extend downwardly and form part of lower surface 9. The upper part of edges 11 are rounded, as is the transition into right taper 14*b*, and corners 13 (shown in FIG. 3A). In the embodiment in FIG. 3C, drain slot width 59 is 0.2 in., strut height 57 is 0.35 in, strut width 85 is 0.5 in. and grate thickness 56 is 0.26 in., which is less than overall grate height 55 because of the downward extension of edges 11. Also best seen in FIGS. 3C and 3D are right angle section 28*b* and right convex tab 29*b*. The flat underside of convex tab 29*b* also forms part of lower surface 9. Left taper 14*a* has similar features labeled 28*a* and 29*a* respectively. Also shown are upper taper height 53, 0.25 in., and lower taper height 54, 0.15 in. In FIG. 3B, grate height 55 is 0.5 in., and grate length 50 is 29.9 in., and in FIG. 3A, grate width 51 is 4.76 in., while drain slot length 58 is 3.1 in. Draining section length 84 is 24.0 in.

Note that as in shown in FIG. 3A, grate 2 is elongate, grate length 50 being approximately 6 times grate width 51. Notable also is that drain slots 12 run parallel to transverse axis 7, normal to grate 2's long axis, thus assisting in easy bending or deformation about axes substantially parallel to transverse axis 7. This deformation permits the distance between grate-ends 4*a*, 4*b*, and tapers 14*a*, 14*b*, to decrease, freeing them (or at least one) from slots 18*a*, 18*b* of frame 15, the bowing effect being shown in FIG. 1.

Figure 4G:
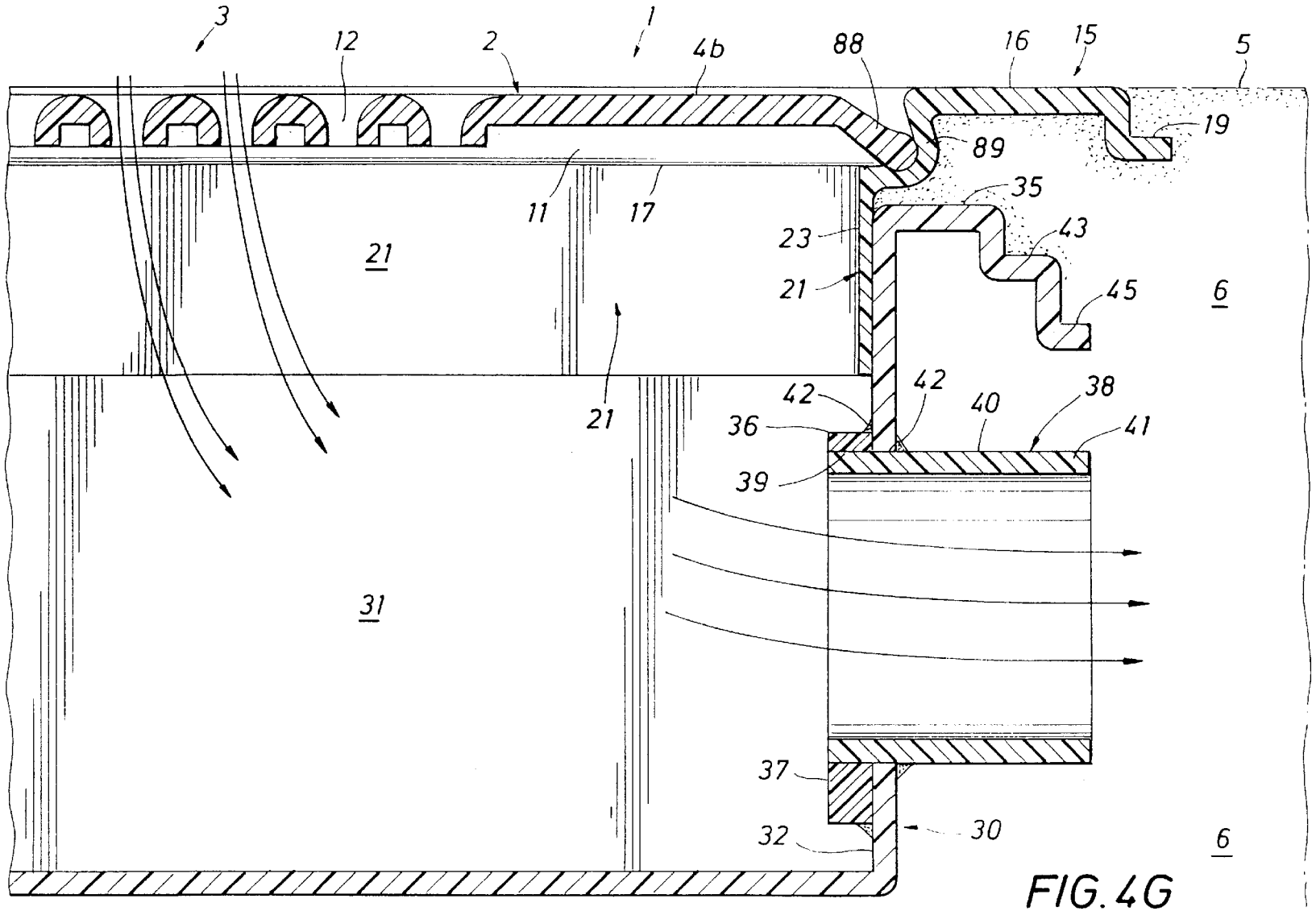
FIG. 4G depicts an alternate embodiment of one end of the present invention as it would appear in section A—A of FIG. 1, as the assembled device would be installed in the floor of a pool or spa.
Figure 5D:
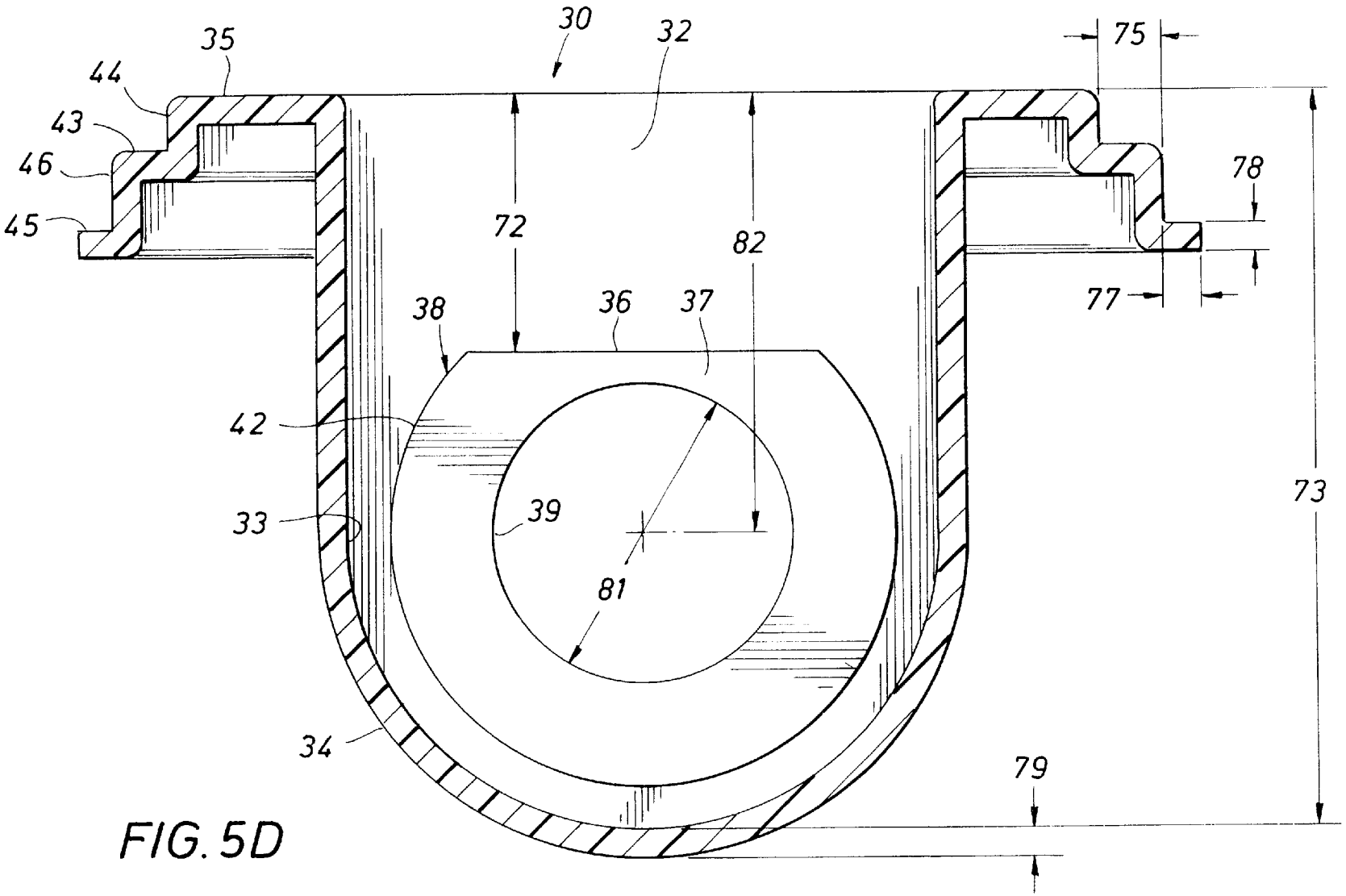
FIG. 5D depicts section E—E of FIG. 5A.

Referring now to FIGS. 4A–E, depicting frame 15, which is also made of molded ABS, in FIG. 4A, frame 15 includes frame face 16, shelves 17, which are placed below the level of frame face 16 (best shown in FIG. 4D), flange 19 and flange corners 20. Referring to FIG. 4B, flange 19 and flange transition 25, which is rounded, are shown. Liquid channel 21 is visible, including lower section 23. Better visible in FIG. 4D are upper section 22 of liquid channel 21 and flange transition 25. Outer surface 26 of liquid channel 21, visible in FIGS. 4B, 4C, and 4D interfaces with end surfaces 32 and side surfaces 33 of cavity 31 of sump 30 (all visible in FIG. 5A), to retain frame 15 in FIG. 4B within sump 30, while permitting translation up and down. Referring to FIG. 4D, liquid channel 21 includes upper section 22, which includes shelves 17, and shelf transitions 24. Shelf transitions 24 are rounded as are flange transitions 25, and corners 27 (better seen in FIG. 4A). In addition, the safety grate apparatus can have a frame comprising at least two vertically-oriented liquid channels, with the safety grate apparatus comprising a sump substantially enclosing the lower section of the liquid channels, and the apparatus at least two grates, where each liquid channel comprises upper and lower sections, the upper sections adjacent to the draining sections so as permit draining from the draining section through the liquid channels. Remaining with FIG. 4D, slot 18*b* is shown and has a width substantially the same as channel width 63, but at least greater than grate width 51 (shown in FIG. 3A), and has slot top 49*b*. Channel width 63 (also shown in FIG. 4A) is 4.95 in. adjacent to slots 18, but narrows to approximately 4.76 in. nearer to the center of frame 15. Inner channel width 64 (also shown in FIG. 4A) is similarly 3.65 in., narrowing to about 3.35 in. Continuing with FIG. 4D, inner channel width 64 is less than channel width 63, the result of placement of shelves 17 of upper section 22 of liquid channel 21 to support edges 11 of grate 2 (as shown in FIG. 2). Shelf transition height 66, (shown also in FIG. 4E) 0.55 in., is substantially the same as slot height, but is at least greater than upper taper height 53 (shown in FIG. 3C). In FIG. 4D, flange 19 has thickness 67, 0.15 in., and transition height 65, 0.35 in. FIG. 4B shows frame length 60, 33.48 in., and FIG. 4A channel length 62, 29.48 in. and frame width 61 7.0 in. FIG. 4C shows frame height 69, 2.0 in. Wall thickness 68, 0.1 in. of liquid channel 21 is shown in FIG. 4E. Wall thickness 68 is less proximate to right slot 18*b* (and similarly left slot 18*a*) than it is along the length of liquid channel 21. Slot height 87, 0.35 in., best seen in FIGS. 4D and 4E, is sufficient to permit entry of at least right convex tab 29*b* into right slot 18*b* (and similarly for the left side shown in FIG. 4F). Wall thicknesses 68 (in FIG. 4E), when added to inner channel width 64, and channel length 62 (in FIG. 4A)—that is the outer dimensions of liquid channel 21 (in FIGS. 4B and 4C)—correspond approximately to the dimensions of cavity 31 of sump 30, cavity length 70 and cavity width 71 (shown in FIG. 5A) to provide a snug fit between them. In one embodiment, two retainers, left and right slots 18*a*, 18*b*, are constructed by cutting or routing out the ABS material from the ends corresponding to channel width 63 and slot height 87, at each end of frame 15. However, another retainer serving the same functions as slots 18*a*, 18*b* may be substituted therefor for one of the two of left and right slots 18*a*, 18*b*, including structures so formed to retain grate-ends 4*a*, 4*b* (shown in FIG. 3A) from upward movement and movement away from the opposite retainer, and to permit rotation of grate-ends 4*a*, 4*b* about transverse axis 7. One alternate embodiment is shown in FIG. 4G, in which a section view of an alternate right grate-end 4*b* has bead 88 which is retained by semi-circular retainer 89.

Moving to FIGS. 5A–D, depicting sump 30, which is also made of molded ABS, in FIG. 5A, sump 30 has cavity 31 extending downwardly into sump 30. Cavity 31 is formed of end surfaces 32 and sides surfaces 33, which are at substantially right angles to one another, and bottom section 34, which is semi-circular in section (best shown in FIGS. 5C and 5D). As best shown in FIG. 2, cavity 31 is the watertight enclosure from which a conventional piping system (not shown) draws water through grate 2 and liquid channel 21 and thence through outlet assemblies 38. Moving to FIG. 5D, step 43 and step transition 44 surround and are below sump face 35 (also shown in FIG. 5B). Similarly flange 45 and flange transition 46 also surround and are below step 43. In FIG. 5A, transitions 44 and 46 have rounded corners 48 and flange 45 has corners 47. Best shown in FIGS. 5A and 5D outlet assembly 38 pierces end surfaces 32 to permit water to be drained into a conventional piping system (not shown). Best shown in FIG. 2, outlet assembly 38 includes ring 37 affixed to end surface 32, sealed thereto using sealant 42 (shown in FIG. 5D). Moving outwardly there are inner threads 39 and passing through end surface 32, there is suction pipe connection 41, having outer threads 40. Suction pipe connection 41, where it penetrates end surface 32 on the outer portion of sump 30, is also sealed using sealant 42. Returning to FIG. 5D, ledge 36 is cut from ring 37 to a depth 72 of 1.55 in. Ledge depth 72 permits frame 15 to be inserted fully into cavity 30 (shown in FIG. 2). Maximum insertion of frame 15 into cavity 30 occurs when the underside of shelves 17 contact sump face 35. At maximum insertion liquid channel 21 does not extend far enough into cavity 31 to block outlet assemblies 38.

In FIG. 5A, cavity 30 has cavity length 70 of 29.8 in., and cavity width 71 of 3.85 in., narrowing to about 3.5 in. near the center. End sump face width 83 is 0.9 in, and the side sump face width 86 is 1.0 in. In FIG. 5D, cavity wall thickness 79 is 0.15 in. and overall sump depth 73 is 4.7 in. Sump 30 has step height 74, 0.35 in., (FIG. 5C) step width 75 (FIG. 5D), 0.4 in., and flange height 76, 0.5 in. (FIG. 5C). Shown in FIG. 5D are flange thickness 78, 0.15 in., and flange width 77, 0.2 in., increasing to 0.3 in. near the center of the length of sump 30.

Referring to FIG. 5D suction pipe connection inner diameter 81 is 1.9 in.; moving to FIG. 5D, its depth is 82 is 2.8 in., and in FIG. 5B, its length 80 is 1.3 in. In this embodiment outlet assemblies 38 are not integrally molded, but are prefabricated and inserted into holes penetrated through end surfaces 32, and sealed using sealant 42 (best shown in FIG. 2). Details of inner threads 39 and outer threads 40 are well known to the art and are the choice of the user to correspond to conventional piping (not shown).

In operation, if a bather were to get their hair, or a finger, or other part of the body caught in the grate of the present invention, the bather could release themselves from pool floor 5 to return to the surface in the following manner. Referring to FIG. 2, by pulling upwardly on the caught body part or hair, the bather will apply a force on draining section 3. While sufficient upward force applied at a position other than draining section 3 will also result in release, it is expected that any such force will be applied at draining section 3 because it is around slot struts 10 in draining section 3 that any body part of hair might get caught. This upward force will bow grate 2, thereby shortening the distance therebetween sufficiently to permit release of one of the left or right grate-ends 4*a*, 4*b*, from slots 18*a*, 18*b* which are a fixed distance apart. Once one of grate-ends 4*a*, 4*b* is free, the other may be removed simply by moving grate 2 away from the remaining slot. Focusing on left and right tapers 14*a* and 14*b*, and referring to FIGS. 3C and 3D, the bowing effect also acts to rotate both of convex tabs 29*a*, 29*b* downward, such that their flat undersides, part of lower surface 9, move away from the top, restraining, surface of slots 18*a*, 18*b*. This also effectively shortens grate 2 because the convex surface of convex tabs 29*a*, 29*b* extend less far toward frame 15.

This invention claimed is:

1. A safety grate apparatus for a pool or spa drain, to protect a swimmer from entrapment, comprising:

at least one deformably releasable grate, said releasable grate having a draining section, at least two sides, and two grate-ends; and a frame engaging and receiving the grate, said frame having two ends, and a retainer formed in each end to releasably retain the grate-ends and to release the grate from the frame when the grate is deformed upwardly between the ends to prevent entrapment of said swimmer.

2. The safety grate apparatus of claim 1, said frame further comprising at least one shelf substantially restraining downward movement, and wherein said sides lack retainers preventing upward movement.

3. The safety grate apparatus of claim 1, the frame further comprising a frame face, wherein said frame face is substantially level with a surface of the pool or spa.

4. The safety grate apparatus of claim 3, the grate further comprising an upper surface, wherein said upper surface is substantially level with a surface of the pool or spa.

5. The safety grate apparatus of claim 1, wherein the grate is elongated between the two grate-ends.

6. The safety grate apparatus of claim 5, wherein the grate is deformable in an arcuate manner about at least one axis substantially transverse to at least two of its sides to release said grate-ends from said retainers.

7. The safety grate apparatus of claim 6, the grate-ends having a rounded bead, wherein the retainers are semicircular.

8. The safety grate apparatus of claim 6, the grate-ends having distal edges, wherein said distal edges are tapered, and the retainers are slots.

9. The safety grate apparatus of claim 8, wherein the grate is substantially prevented from deforming downwardly.

10. The safety grate apparatus of claim 9, wherein the grate comprises a lower surface, and the frame further comprises at least two shelves extending beneath a portion of said lower surface, and said shelves substantially prevent the grate from deforming downwardly.

11. A safety grate apparatus for a pool or spa drain, comprising:

at least one deformably releasable grate, said releasable grate having a draining section, and two grate-ends;

a frame engaging the grate, said frame having at least one retainer formed in each end to receive the grate-ends;

the grate being elongated between the two grate-ends;

the grate being deformable in an arcuate manner to release said grate-ends from said retainers to protect a swimmer from entrapment;

the grate-ends having distal edges, wherein said distal edges are tapered, and the retainers are slots;

the grate being substantially prevented from deforming downwardly;

the grate comprising a lower surface, and the frame further comprises at least two shelves extending beneath a portion of said lower surface, and said shelves substantially prevent the grate from deforming downwardly;

the frame further comprising:

a frame face;

at least one liquid channel;

at least one flange, and the grate further comprising an upper surface, wherein the draining section has a plurality of transverse slots formed therethrough, and the frame face and the grate's upper surface are substantially level, and the shelves are integral with the liquid channel.

12. The safety grate apparatus of claim 11, wherein the grate is deformable in an arcuate manner about at least one axis substantially transverse to its elongated dimension to release said grate-ends from said retainers.

13. The safety grate apparatus of claim 8, the frame further comprising at least one liquid channel.

14. The safety grate apparatus of claim 13, the liquid channel comprising upper and lower sections, said upper section adjacent to the draining section so as to permit draining from the draining section through the liquid channel, wherein the frame encloses the grate.

15. The safety grate apparatus of claim 14, wherein the liquid channel is vertically-oriented, and the safety grate apparatus further comprises a sump substantially enclosing the lower section of the liquid channel.

16. A safety grate apparatus for a pool or spa drain, comprising:

at least one deformably releasable grate, said releasable grate having a draining section, and two grate-ends;

a frame engaging the grate, said frame having at least one retainer formed in each end to receive the grate-ends;

the grate being elongated between the two grate-ends;

the grate being deformable in an arcuate manner to release said grate-ends from said retainers to protect a swimmer from entrapment;

the grate-ends having distal edges, wherein said distal edges are tapered, and the retainers are slots;

the frame further comprising at least one liquid channel, said liquid channel comprising upper and lower sections, said upper section adjacent to the draining section so as to permit draining from the draining section through the liquid channel, wherein the frame encloses the grate;

wherein the liquid channel is vertically-oriented, and the safety grate apparatus further comprises a sump substantially enclosing the lower section of the liquid channel; and wherein the sump comprises:

a cavity;

at least one outlet penetrating the cavity;

an outer flange;

and the cavity comprises two sets of opposed, vertical, internal surfaces to restrain horizontal motion of the lower section of the liquid channel, but permit vertical translation.

17. The safety grate apparatus of claim 16, wherein the grate is deformable in an arcuate manner about at least one axis substantially transverse to its elongated dimension to release said grate-ends from said retainers.

18. A safety grate apparatus for a pool or spa drain, comprising:

an elongated grate, having an upper surface, comprising:

a draining section; and two grate-ends;

a frame, having two ends, having at least one slot formed in each end to receive and retain the grate-ends;

wherein said grate is bendable upwardly to release said grate-ends from said slots to protect a swimmer from entrapment.

19. The safety grate apparatus of claim 18, the grate-ends having distal edges, each of said distal edges comprising a taper section, wherein the grate is bendable in an arcuate manner between said taper sections.

20. A safety grate apparatus for a pool or spa drain, comprising:

an elongated grate, having an upper surface, comprising:

a draining section; and two grate-ends;

a frame, having two ends, having at least one slot formed in each end to receive the grate-ends;

wherein said grate is bendable upwardly to release said grate-ends from said slots to protect a swimmer from entrapment;

the grate-ends having distal edges, each of said distal edges comprising a taper section, wherein the grate is bendable in an arcuate manner between said taper sections; and said taper section comprising a proximal angle section, and a distal convex tab having a corner, wherein each of said convex tabs are wholly received by the slots and said slots impede upward motion of the grate at a plurality of contact points.

21. A safety grate apparatus for a pool or spa drain, comprising:

an elongated grate, having an upper surface, comprising:

a draining section;

two grate-ends; and a plurality of axes transverse to its elongated dimension;

a frame, having two ends, having at least one slot formed in each end to receive the grate-ends;

wherein said grate is bendable upwardly to release said grate-ends from said slots to protect a swimmer from entrapment;

the grate-ends having distal edges, each of said distal edges comprising a taper section, wherein the grate is bendable in an arcuate manner between said taper sections;

said taper section comprising a proximal angle section, and a distal convex tab having a corner, wherein each of said convex tabs are wholly received by the slots and said slots impede upward motion of the grate at a plurality of contact points; and wherein each of the convex tabs comprise a corner and a convex upper surface, and rotation of said convex tabs about the transverse axes results in the contact points being farther apart along the upper surface of the grate.

22. The safety grate apparatus of claim 21, wherein an upward force of seven pounds or more applied near the grate-ends bends the grate sufficiently to release a convex tab from its slot.

23. The safety grate apparatus of claim 22, wherein the grate comprises a lower surface, and the frame further comprises at least two shelves extending beneath a portion of said lower surface, and said shelves substantially prevent the grate from deforming downwardly.

24. The safety grate apparatus of claim 23, the frame further comprising:

an upper surface;

at least one flange, and the grate further comprising an upper surface, wherein the frame's upper surface and the grate's upper surface are substantially level, and wherein the shelves form a part of the liquid channel.

25. The safety grate apparatus of claim 21, the frame further comprising at least one vertically-oriented liquid channel comprising upper and lower sections, said upper section adjacent to the draining section so as permit draining from the draining section through the liquid channel.

26. The safety grate apparatus of claim 25 further comprising a sump substantially enclosing the lower section of the liquid channel, the sump comprising:

a cavity;

at least one outlet penetrating the cavity;

an outer flange;

wherein the cavity comprises two sets of opposed, vertical, internal surfaces to restrain horizontal motion of the lower section of the liquid channel, but permit vertical translation.

27. A safety grate apparatus for a main drain of a pool or spa, comprising:

an elongated grate, having an upper surface;

a draining section;

at least two elongated sides; and two grate-ends, having a transverse axis extending along each grate-end;

a frame, comprising:

a liquid channel; and a flanged frame face, said liquid channel having two ends, each end having a slot formed therein to receive the grate-ends; and said grate being substantially deformable about a plurality of bending axes substantially parallel to the transverse axes to release the grate-ends from the slots to protect a swimmer from entrapment.

28. A safety grate apparatus for a main drain of a pool or spa, comprising:

a grate, having an upper surface;

a draining section; and two grate-ends, having a transverse axis extending along each grate-end;

a frame, comprising:

a liquid channel; and a flanged frame face, said liquid channel having two ends, each end having a slot formed therein to receive the grate-ends; and said grate being substantially deformable about a plurality of bending axes substantially parallel to the transverse axes to release the grate-ends from the slots to protect a swimmer from entrapment;

wherein each of said grate-ends comprise an angle section and a convex tab, and each of said convex tabs is fully receivable by the slots, and said slots impede upward motion of the grate at a plurality of contact points.

29. The safety grate apparatus of claim 28, wherein each of the convex tabs comprises a corner and a convex upper surface, and rotation of said tabs about a transverse axis results in the contact points being farther apart on the upper surface of the grate.

30. A method of releasing a swimmer caught in a pool or spa drain system, comprising the steps of:

covering an elongated drain frame in a pool with an upwardly deformable elongated grate having a draining section that is removably secured with the elongated drain frame; and releasing the deformable elongated grate from the elongated drain frame by applying a small upward force to the draining section of the grate, thereby bending the grate upwardly and releasing the grate from the frame to release the swimmer and prevent injury and drowning.

31. The method of claim 30, including the step of:

bending the grate upwardly substantially in the draining section about bending axes parallel to the grate-ends of the grate.

32. The method of claim 31, including the step of:

moving convex tabs on the grate more closely together by deforming the grate upwardly.

33. The method of claim 32, including the step of:

rotating at least one of said convex tabs downward, thereby further shortening the grate.

34. The method of claim 36, wherein the covering step is further defined as covering the elongated drain frame with an upwardly deformable elongated grate removably secured at two shorter ends of the elongated grate.

35. The method of claim 34, wherein the releasing step is further defined as releasing the two shorter ends of the grate from the frame.

36. A pool safety grate apparatus, comprising:

at least one deformably releasable grate, said releasable grate having a slotted section, two sides, and two grate-ends, wherein the grate is elongated between the two grate-ends; and a frame supporting and receiving the grate, said frame having two ends, at least one retainer formed in each end to releasably retain the grate-ends;

wherein the grate is deformable in an arcuate manner about at least one axis substantially transverse to the sides to release said grate-ends from said retainers to protect a swimmer from entrapment.

37. A pool safety grate apparatus, comprising:

an elongated grate, comprising a draining section and two grate-ends forming ends of said elongated grate; and a frame, having two ends, each end having at least one slot formed therein to releasably retain the grate-ends;

wherein said grate is bendable by bowing upwardly along an axis between the grate-ends to release said grate-ends from said slots to protect a swimmer from entrapment.

38. A pool safety grate apparatus for a pool or spa drain, comprising:

at least one deformably releasable grate, said releasable grate having a draining section, and two grate-ends, wherein said draining section has drain slots formed therein, said drain slots having long axes, wherein said long axes are substantially parallel to said grate-ends; and a frame engaging and receiving the grate, said frame having two ends, and at least one retainer formed in each end to releasably retain the grate-ends, wherein upward deformation of the grate releases said grate to protect a swimmer from entrapment.

39. The safety grate apparatus of claim 38, wherein said grate is bendable by bowing upwardly along an axis between the grate-ends to release said grate-ends from said slots.

40. A method of releasing a swimmer caught in a pool or spa drain system, comprising the steps of:

a pool or spa interior with an upwardly deformable grate, having a draining section and ends, that is removably secured by its ends to the drain frame; and releasing the deformable grate from a drain frame by applying a small force away from the grate to the draining section of the grate, thereby bending the grate upwardly between the ends, and releasing the ends of the grate from the frame, permitting release of the swimmer and preventing injury and drowning.

41. The method of claim 40, wherein the releasing step is further defined as bending the grate upwardly substantially in the draining section about bending axes parallel to the ends of the grate.

42. The method of claim 40, wherein the releasing step is further defined as bowing the grate and reducing the distance between the ends.

* * * * *